US008915691B2

(12) United States Patent
Mintz

(10) Patent No.: US 8,915,691 B2
(45) Date of Patent: Dec. 23, 2014

(54) APPARATUS FOR TRANSPORTING FRAC SAND IN INTERMODAL CONTAINER

(76) Inventor: Michael Mintz, Corpus Christi, TX (US)

( * ) Notice: Subject to any disclaimer, the term of this patent is extended or adjusted under 35 U.S.C. 154(b) by 293 days.

(21) Appl. No.: 13/342,107

(22) Filed: Jan. 1, 2012

(65) Prior Publication Data

US 2013/0004272 A1 Jan. 3, 2013

Related U.S. Application Data

(60) Provisional application No. 61/429,046, filed on Dec. 31, 2010.

(51) Int. Cl.

| | |
|---|---|
| ***B65D 88/68*** | (2006.01) |
| ***B65D 88/30*** | (2006.01) |
| ***B65D 88/54*** | (2006.01) |
| *B65D 88/12* | (2006.01) |

(52) U.S. Cl.

CPC ..... *B65D 88/30* (2013.01); *B65D 88/54* (2013.01); *B65D 88/121* (2013.01)

USPC ..... 414/305; 198/533; 406/127; 406/18; 406/28

(58) Field of Classification Search

CPC .... B65G 53/4675; B65D 88/60; B65D 88/62; B65D 90/56

USPC ..... 414/305; 198/533; 222/442; 299/95; 406/18, 28, 29, 127

See application file for complete search history.

(56) References Cited

U.S. PATENT DOCUMENTS

| | | | | |
|---|---|---|---|---|
| 3,303,974 | A * | 2/1967 | Bleuler | 222/445 |
| 3,433,245 | A * | 3/1969 | Cymbalisty | 137/242 |
| 4,893,966 | A * | 1/1990 | Roehl | 406/127 |
| 5,011,376 | A * | 4/1991 | Henriksson et al. | 417/145 |
| 5,147,185 | A * | 9/1992 | Niehaus et al. | 417/394 |
| 5,274,736 | A * | 12/1993 | Rohr, Jr. | 392/447 |
| 5,697,523 | A * | 12/1997 | Brandauer | 222/58 |
| 6,171,023 | B1 * | 1/2001 | Townshend | 405/94 |
| 6,283,680 | B1 * | 9/2001 | Vidal | 406/128 |
| 7,093,674 | B2 * | 8/2006 | Paluch et al. | 175/48 |
| 8,172,558 | B2 * | 5/2012 | Hasegawa et al. | 418/3 |
| 8,397,745 | B2 * | 3/2013 | Hurst | 137/119.03 |
| 8,616,358 | B2 * | 12/2013 | Dunn et al. | 193/25 B |
| 8,689,494 | B2 * | 4/2014 | Leavitt | 52/63 |
| 2003/0234120 | A1 * | 12/2003 | Paluch et al. | 175/50 |
| 2005/0194405 | A1 * | 9/2005 | Kosich | 222/181.1 |
| 2009/0050446 | A1 * | 2/2009 | Cliff et al. | 198/546 |
| 2011/0197846 | A1 * | 8/2011 | Shinomiya et al. | 123/196 R |
| 2013/0206242 | A1 * | 8/2013 | Hurst | 137/12 |

* cited by examiner

*Primary Examiner* — Joseph Dillon, Jr.

(74) *Attorney, Agent, or Firm* — Harrison Law Office, P.C.

(57) ABSTRACT

Apparatus for transporting frac sand and/or proppant for use in standard ISO intermodal containers and for delivering frac sand and/or proppant to well sites. Configured for being inserted into a container and adapted for transporting frac sand and proppant from a quarry or other frac sand supply source to a well site. A plurality of inlet ports disposed atop the roof, with the inlet ports receiving the frac sand from a frac sand supply source into a funnel-hopper, and a plurality of outlet ports for receiving the frac sand and proppant within the funnel-hopper and delivering the frac sand and proppant proximal to the well site. An in situ valve apparatus disposed within the hopper assembly for effectuating industry standard continuous pressurized discharge of stored frac sand material into a discharge pipe for delivery downhole.

7 Claims, 14 Drawing Sheets

| Transportation Cost of 1 Frac Crew per Month | Conventional System | Barge/Container System |
|---|---|---|
| Number of Jobs 1 Frac Crew Can Do in 1 Month | 4 | 4 |
| Average Weight of Sand per Job (lb) | 3,750,000 | 3,750,000 |
| Required Sand (lb/Month) | 15,000,000 | 15,000,000 |
| Required Sand (Tons/Month) | 7,500 | 7,500 |
| Freight Cost ($/Ton) | 50 | 40 |
| Railroad Freight Cost ($/Month) | 375,000 | |
| Barge Freight Cost ($/Month) | | 300,000 |
| Railcar Capacity (lb/Car) | 200,000 | |
| Barge Capacity ($/Barge) | | 3,000,000 |
| Number of Required Hopper Cars per Month | 75 | |
| Number of Required Barges per Month | | 5 |
| Container Capacity (lb/Container) | | 50,000 |
| Number of Required Containers per Month | | 60 |
| Effective number of Leased Containers per Month | | 80 |
| Transportation Time (Days/Cycle) | 21 | |
| Demurrage Time (Days/Cycle) | 14 | |
| Effective number of Hopper Cars Required per Month | 47 | |
| Demurrage Fee ($/Car/Day) | 50 | |
| Demurrage Fee ($/Month) | 32,900 | |
| Hopper Car Offloading Cost ($/Car) | 500 | |
| Hopper Car Offloading Cost ($/Month) | 37,500 | |
| Barge Offloading Stevedore Services | | 4 |
| Barge Offloading Cost/Month | | 30,900 |
| Barge Dock Lease ($/Month) | | 4,000 |
| Port Fees ($/Ton) | | 0.50 |
| Port Fees ($/Month) | | 3,750 |
| Number of Loaded Container Handlers Required | | 2 |
| Loaded Container Handler Lease Cost ($/Month/Handler) | | 0 |
| Loaded Container Handler Lease Cost ($/Month) | | 0 |
| Number of Employees to Load/Offload Containers | | 3 |
| Monthly Wage ($/Employee) | | 3,000 |
| Container Loading/Offloading Labor Expenses ($/Month) | | 6,000 |
| 75 Ton Crane Rental | | 0 |
| Yard Spotter Rental | | 1,500 |
| Hopper Car Lease Cost ($/Car/Month) | 500 | |
| Container Lease Cost ($/Container/Month) | | |
| Container Lease Cost ($/Month) | | 0 |
| Hopper Car Lease Cost ($/Month) | 23,500 | |
| Capacity of Truck (lb) | 50,000 | 50,000 |
| Number of Truckloads Needed to Deliver Sand | 300 | 300 |
| Roundtrip Flat Rate Delivery Cost ($/Truckload) | 1,000 | 1,000 |
| Distance Differential Cost ($/hr) | | 0 |
| Distance Differential (hr/Month) | | 0 |
| Distance Differential ($/Month) | | 0 |
| Trucking Cost ($/Month) | 300,000 | 210,000 |
| Trucking Wait Time at Rig (hr) | 2 | 0 |
| Hourly Cost of Wait Time ($/hr) | 70 | 50 |
| Truck Wait Time Cost ($/Month) | 42,000 | 0 |
| Trucking Cost for Material Handling Equipment ($/Month) | | 8,000 |
| Overweight Permit ($/Month/Truck) | | 400 |
| Number of Trucks Requiring Permits | | 6 |
| Permit Cost ($/Month) | | 2,400 |
| Number of Trailers Required | | |
| Trailer Lease Cost ($/Trailer/Month) | | 0 |
| Trailer Lease Cost ($/Month) | | 0 |
| TOTAL COST | 810,900 | 566,550 |

FIG. 10

| Sand Valve Discharge Rates | | | | | | |
|---|---|---|---|---|---|---|
| Cycles per Minute | Volume per Minute Cu-Ft | Weight per Minute | Time for 50,000 Lbs Min | Valve Volume Cu-Ft | Valve Type | Useable Range |
| 60 | 15 | 1500 | 33.33 | 0.25 | Single 2x1.375 | Y |
| 30 | 7.5 | 750 | 66.67 | 0.25 | Single 2x1.375 | |
| 20 | 5 | 500 | 100.00 | 0.25 | Single 2x1.375 | |
| 15 | 3.75 | 375 | 133.33 | 0.25 | Single 2x1.375 | |
| 12 | 3 | 300 | 166.67 | 0.25 | Single 2x1.375 | |
| 10 | 2.5 | 250 | 200.00 | 0.25 | Single 2x1.375 | |
| 8 | 2 | 200 | 250.00 | 0.25 | Single 2x1.375 | |
| 6 | 1.5 | 150 | 333.33 | 0.25 | Single 2x1.375 | |
| 5 | 1.25 | 125 | 400.00 | 0.25 | Single 2x1.375 | |
| 4 | 1 | 100 | 500.00 | 0.25 | Single 2x1.375 | |
| | | | | | | |
| 60 | 30 | 3000 | 16.67 | 0.5 | Double 2x1.375 | Y |
| 30 | 15 | 1500 | 33.33 | 0.5 | Double 2x1.375 | Y |
| 20 | 10 | 1000 | 50.00 | 0.5 | Double 2x1.375 | |
| 15 | 7.5 | 750 | 66.67 | 0.5 | Double 2x1.375 | |
| 12 | 6 | 600 | 83.33 | 0.5 | Double 2x1.375 | |
| 10 | 5 | 500 | 100.00 | 0.5 | Double 2x1.375 | |
| 8 | 4 | 400 | 125.00 | 0.5 | Double 2x1.375 | |
| 6 | 3 | 300 | 166.67 | 0.5 | Double 2x1.375 | |
| 5 | 2.5 | 250 | 200.00 | 0.5 | Double 2x1.375 | |
| 4 | 2 | 200 | 250.00 | 0.5 | Double 2x1.375 | |
| | | | | | | |
| 60 | 24.168 | 2416.8 | 20.69 | 0.4028 | Single 3x1.375 | Y |
| 30 | 12.084 | 1208.4 | 41.38 | 0.4028 | Single 3x1.375 | Y |
| 20 | 8.056 | 805.6 | 62.07 | 0.4028 | Single 3x1.375 | |
| 15 | 6.042 | 604.2 | 82.75 | 0.4028 | Single 3x1.375 | |
| 12 | 4.8336 | 483.36 | 103.44 | 0.4028 | Single 3x1.375 | |
| 10 | 4.028 | 402.8 | 124.13 | 0.4028 | Single 3x1.375 | |
| 8 | 3.2224 | 322.24 | 155.16 | 0.4028 | Single 3x1.375 | |
| 6 | 2.4168 | 241.68 | 206.89 | 0.4028 | Single 3x1.375 | |
| 5 | 2.014 | 201.4 | 248.26 | 0.4028 | Single 3x1.375 | |
| 4 | 1.6112 | 161.12 | 310.33 | 0.4028 | Single 3x1.375 | |
| | | | | | | |
| 60 | 48.336 | 4833.6 | 10.34 | 0.8056 | Double 3x1.375 | Y |
| 30 | 24.168 | 2416.8 | 20.69 | 0.8056 | Double 3x1.375 | Y |
| 20 | 16.112 | 1611.2 | 31.03 | 0.8056 | Double 3x1.375 | Y |
| 15 | 12.084 | 1208.4 | 41.38 | 0.8056 | Double 3x1.375 | Y |
| 12 | 9.6672 | 966.72 | 51.72 | 0.8056 | Double 3x1.375 | |
| 10 | 8.056 | 805.6 | 62.07 | 0.8056 | Double 3x1.375 | |
| 8 | 6.4448 | 644.48 | 77.58 | 0.8056 | Double 3x1.375 | |
| 6 | 4.8336 | 483.36 | 103.44 | 0.8056 | Double 3x1.375 | |
| 5 | 4.028 | 402.8 | 124.13 | 0.8056 | Double 3x1.375 | |
| 4 | 3.2224 | 322.24 | 155.16 | 0.8056 | Double 3x1.375 | |
| | | | | | | |

FIG. 20

APPARATUS FOR TRANSPORTING FRAC SAND IN INTERMODAL CONTAINER

RELATED APPLICATIONS

This application claims priority based upon U.S. Provisional Application Ser. No. 61/429,046 filed Dec. 31, 2010.

FIELD OF THE INVENTION

The present invention pertains to an apparatus for transporting frac sand, and more particularly pertains to apparatus allowing adaptation of an ISO intermodal container for transporting frac sand from its supplier to a well site at which in situ hydrocarbon formation-fracturing operations will be effectuated.

BACKGROUND OF THE INVENTION

In oilfield applications, pump assemblies are commonly invoked for pumping fluid at high pressures from the surface of the well downhole to a wellbore. Such oilfield operations frequently involve hydraulic fracturing. For hydraulic fracturing (herein abbreviated "fracking" for convenience), an abrasive-containing fluid such as sand and other fracking or frac materials (collectively termed "proppant") are pumped through the wellbore and into targeted regions thereof, to create side "fractures" within the underlying hydrocarbon formations.

As is will known in the art, in order to create such fractures, frac fluid containing abrasive proppant is pumped downhole at extremely high pressures not only to facilitate fracture-creation, but also to sustain the propped-open structures. As will be appreciated by those skilled in the art, these propped-open structures afford additional pathways for underground oil and gas deposits to flow from underground formations to the well surface, thereby enhancing well production.

Prior art apparatus and methodology for transporting frac fluid containing sand and proppant suffer from several long-standing disadvantages. For instance, after being loaded onto special-purpose pneumatic trucks or railcars, frac sand and proppant have typically not been well sealed from environmental incursions during transfer. As a consequence of such environmental incursions, the integrity of this material has been seriously undermined whereupon significant degradation attributable to cumulative effects of abrasion and friction, and exposure to moisture and rain occur during material transfer operations. Since it has been difficult—if not virtually impossible—for special-purpose railcars and pneumatic trucks to be brought sufficiently close to well sites, it has become a prevalent occurrence for several material transfers to be prerequisite for ultimate delivery of sufficient frac sand and/or proppant to the intended well site so that fracking operations may be initiated. Moreover, pneumatic trucks are frequently unavailable and unloading of frac sand from trucks or railcars is likewise frequently delayed, wherein railcars remain idle, with railroads charging significant demurrage fees.

Accordingly, what is needed in the art is an apparatus and concomitant methodology for improving the logistics for transporting frac sand and proppants proximal to well sites to avoid these several longstanding limitations and disadvantages prevalent in the prior art. This need is fulfilled by embodiments of the present invention which contemplate novel application of standard ISO shipping containers to accommodate an internal structure adapted to support and strengthen the walls and floor of such ISO shipping containers and a valve apparatus configured to efficiently and securely achieve prerequisite sand and proppant material transfer from such adapted containers to fracking operations regardless of the remoteness and limited accessibility of a diversity of well site locations.

Such intermodal shipping or freight containers enable reusable transport and storage units for moving products and raw materials between locations. Containers manufactured to ISO specifications are commonly be referred to as "ISO containers," wherein, as well known in the shipping art, ISO corresponds to an acronym for the International Organization for Standardization which promulgates worldwide industrial and commercial standards. ISO containers suitable for sand and proppant transfer and delivery to well site locations should preferably be sized with 20-foot length, and with 8½-foot height and 8-foot width. To be able to accommodate the substantial quantity of materials stored and transported to well site locations, often over rough terrain and under exigent conditions, the container's external frame should preferably be reinforced with appropriate bracing and trusses.

FIGS. 11 and 12 depict typical standard ISO shipping containers suitable for receiving embodiments of the present invention. More particularly, FIG. 11 depicts an end perspective view of a standard ISO container, with its end-opening doors disposed in an open position. FIG. 12 depicts a frontal perspective view of a portion of internal bracing framework incorporated into the ISO container depicted in FIG. 11, wherein the storage capacity of the enclosing walls and the like are reinforced with braces and trusses as taught hereunder to accommodate the quantity of sand and proppant as will be described hereinafter. As clearly shown in FIG. 12, the standard ISO container should preferably have a clear span—a span devoid of columns or structural walls or the like present. Of course, any of a plethora of known bracing and truss designs may be implemented in order to achieve the prerequisite container strength and capacity contemplated herein throughout the container's 20-foot length.

Once a standard 20-foot ISO container has been suitably reinforced with an internal bracing structure, an apparatus is needed for timely transferring the enclosed sand or proppant to the high pressure delivery system at the well site, preferably nominally within an hour's time frame. This material transfer apparatus comprises a hopper/valve assembly configured to deliver the material to ports at the well site where in situ fracturing operations will be conducted.

SUMMARY OF THE INVENTION

As will be hereinafter described in detail, embodiments of the frac sand and/or proppant transfer apparatus contemplated by the present invention are effectuated by modifying a Standard 20-foot ISO intermodal shipping container by incorporation of a structure therein comprising the following components:

1. Horizontal and angular peripheral bracing framework to strengthen the side walls of such standard ISO intermodal shipping container as contemplated herein, and to serve as an adequate anchoring structure for supporting the aluminum or steel plates that comprise a funnel-hopper member of a hopper discharge assembly, for, in turn, thereby creating the prerequisite angulation for achieving adequate discharge of sand flow from the hopper discharge assembly to support downhole fracking operations.
2. Central vertical support framework for anchoring the central section of this hopper discharge assembly, and for allowing the necessary angulation for obtaining the contemplated sand flow.

3. Embodiments of this hopper assembly comprising preferably four aluminum or steel plate members, and associated stiffening rod members—preferably angled at about 31° from the horizontal—functioning as a funnel-hopper member downwardly directing the implicated sand into a discharge pipe. This funnel-hopper assembly may be disposed in either a single or double configuration within the ISO intermodal shipping container.

Embodiments of the present invention constitute a module preferably constructed from steel and having intake and discharge ports configured to mate with hopper assembly ports disposed at the well site. This module should preferably be adapted to slide into and out of a standard ISO container contemplated hereunder. Other embodiments may be constructed with a bladder system including high-density firm elastomeric material similar to material incorporated into military fuel storage containers. As will be hereinafter described in detail, a central bladder is configured to hold the sand and proppant material, and the associated side bladders are configured to be inflated in order to control sand and proppant material discharge.

It will be appreciated that an important aspect of the transfer apparatus taught by the present invention is to control the discharge flow rate of frac sand and proppant material whereby the stored material must be completely sealed and then this transported material must be properly discharged such that the container is emptied at well site in 60 minutes or preferably less. As will be understood by those conversant in the art that mere gravity-feed of this material results in inadequate flow rates to perform the unloading and delivery of sand and proppant prerequisite for conventional fracturing operations at the well site. Hence, the efficacy of embodiments of the present invention which invoke either a single-valve system or a double-valve system to achieve prerequisite material transfer in industry standard time.

These and other objects of the present invention will become apparent from the following specification and accompanying drawings, wherein like numerals refer to like components.

BRIEF DESCRIPTION OF THE DRAWINGS

FIG. 10 depicts a spreadsheet tabulating a comparative analysis of frac sand delivery according to prior art hopper apparatus and concomitant methodology vis a vis apparatus and concomitant methodology according to embodiments of the present invention.

FIG. 20 depicts a tabulation of sand valve discharge flow rates.

DETAILED DESCRIPTION OF THE INVENTION

Embodiments of the present invention comprise specially configured assembly adapted for modifying a standard 20-foot ISO intermodal shipping container and the like. More particularly, as will become evident to those skilled in the art, embodiments of the instant frac sand transport apparatus are configured to enable each of its plurality of intake ports and similar plurality of discharge ports to be conveniently coupled with preexisting conventional input channels and output channels located in situ not only at the processing facility where the frac sand is produced, but also at the well site where fracturing operations will be conducted.

Figure 1:
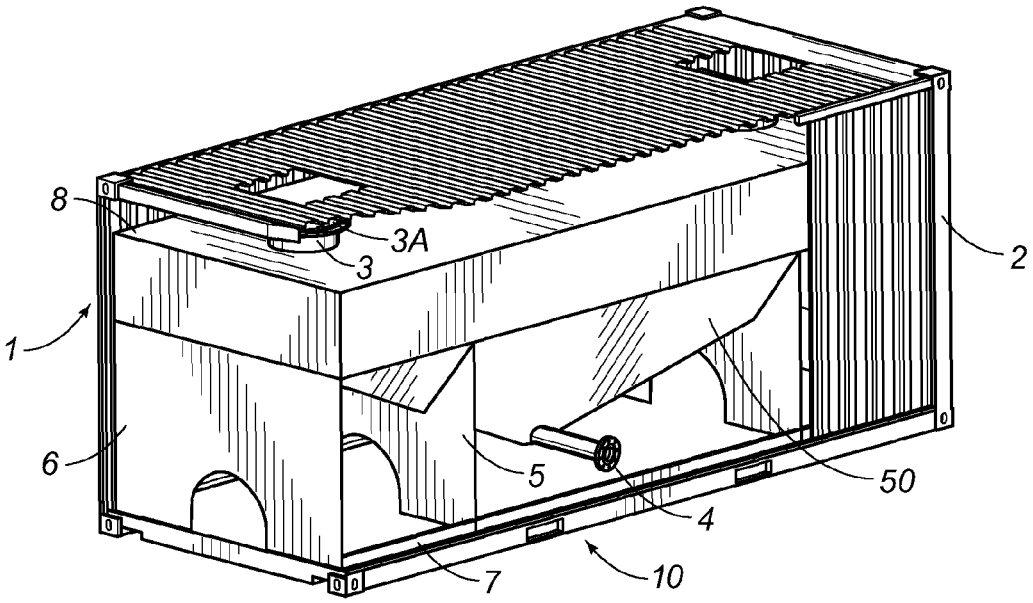
FIG. 1 depicts a frontal view of an embodiment of the present invention.
Figure 2:
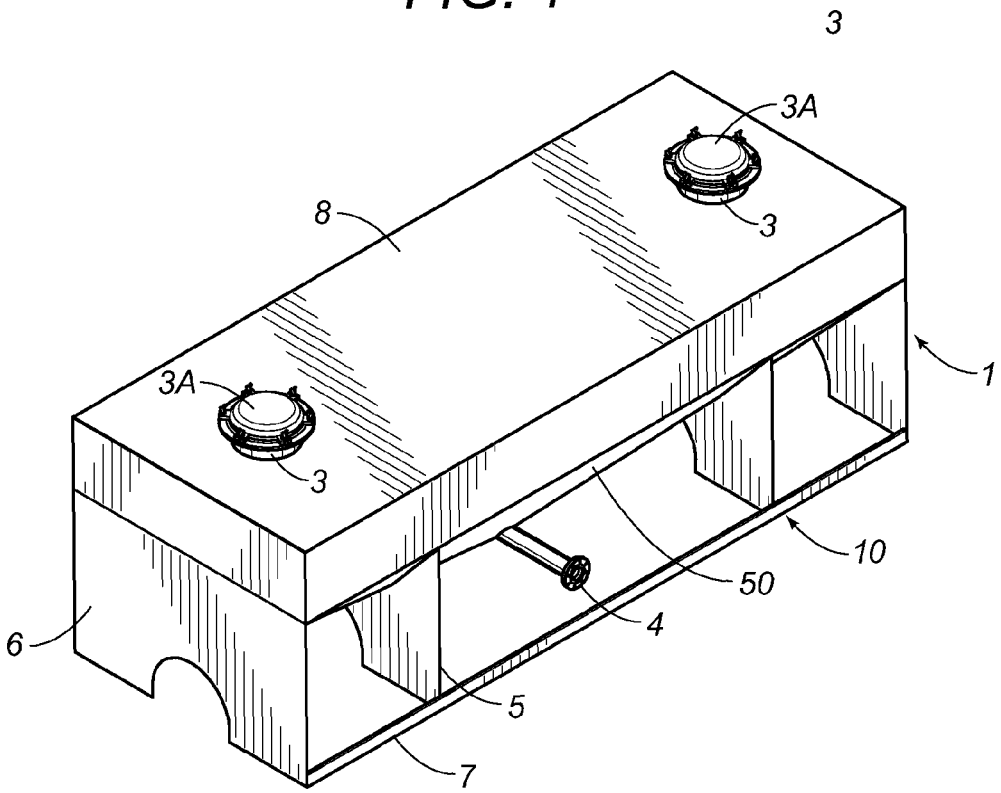
FIG. 2 depicts a side view of the embodiment depicted in FIG. 1.

Referring collectively to FIGS. 1-8, there is depicted a preferred embodiment 1 of an apparatus for transporting frac sand in an intermodal container 2 (only partially shown). More particularly, FIG. 1 depicts a perspective view and FIG. 2 depicts an isometric view, respectively, of frac sand transport apparatus 1, comprising plurality of inlet ports 3, plurality of outlet transverse discharge ports 4, plurality of saddle supports 5, pair of end supports 6, pair of cross-braces 7, and roof 8.

Figure 3:
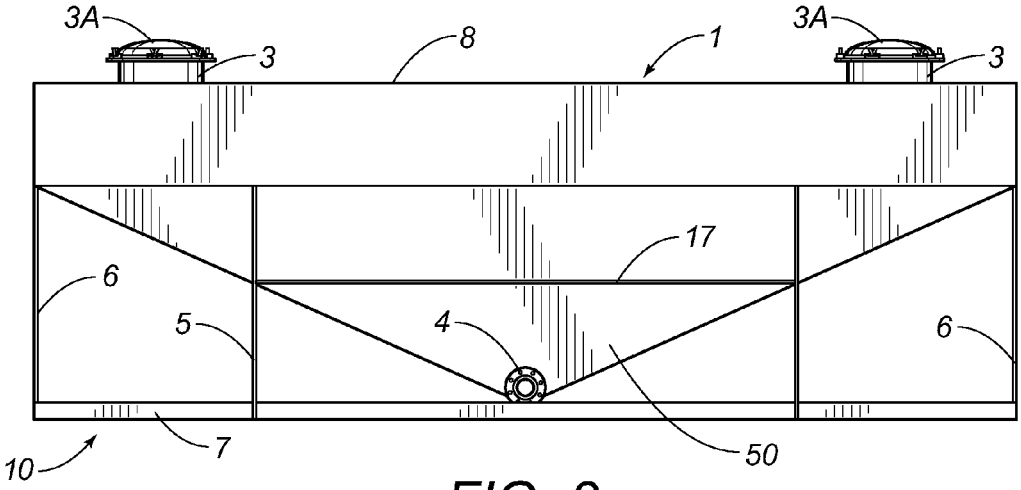
FIG. 3 depicts a top view of the embodiment depicted in FIGS. 1 and 2.
Figure 4:
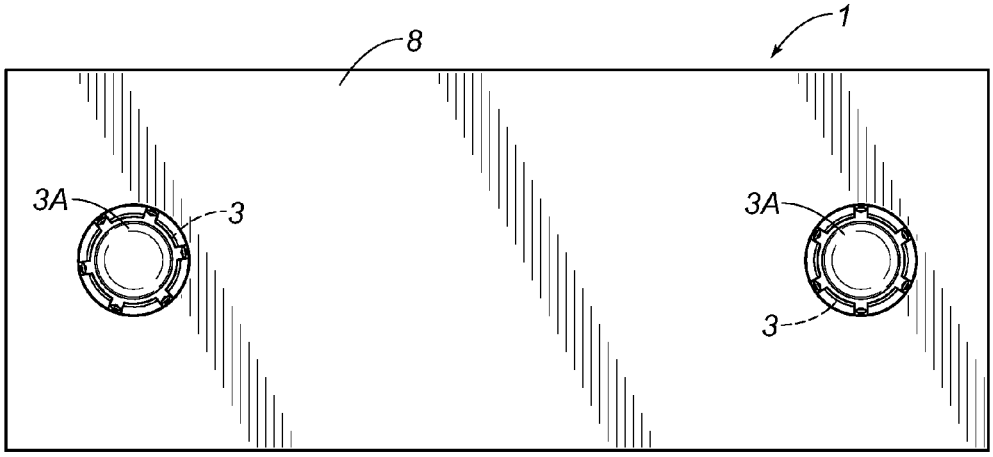
FIG. 4 depicts a top planar view of the embodiment of the present invention depicted in FIGS. 1 and 2.
Figure 5:
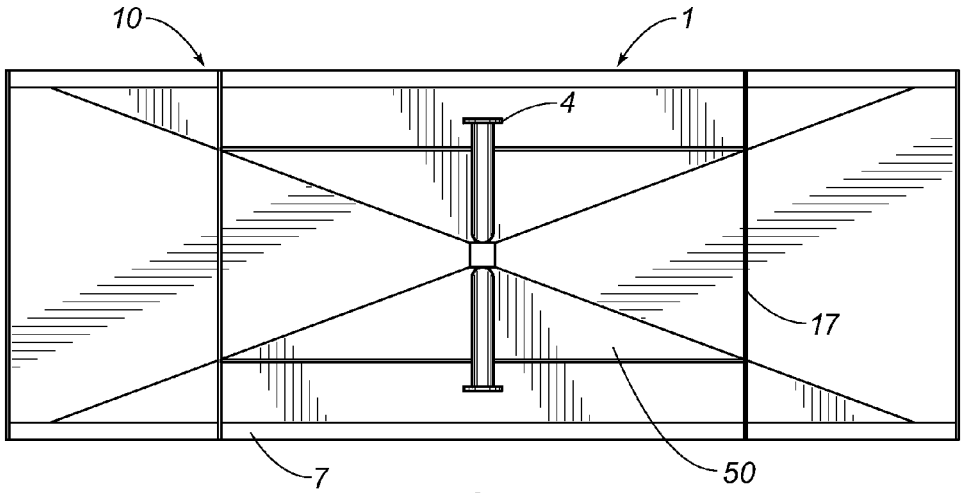
FIG. 5 depicts a bottom view of the embodiment of the present invention depicted in FIGS. 1 and 2.
Figure 6:
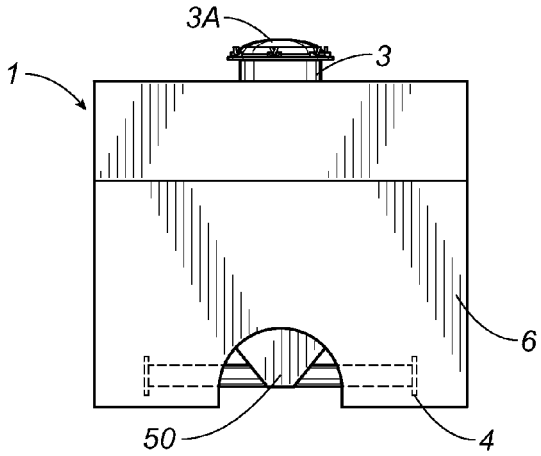
FIG. 6 depicts a right side or end view of the embodiment of the present invention depicted in FIGS. 1 and 2.
Figure 7:
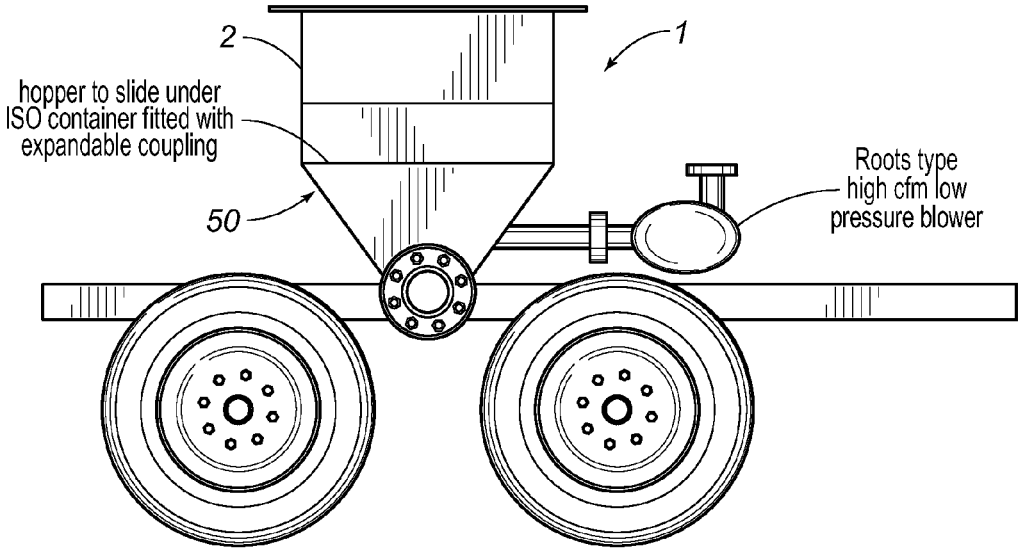
FIG. 7 depicts an isolated frontal view of the embodiment of the present invention depicted in FIGS. 1-6, disposed upon a truck trailer.
Figure 8:
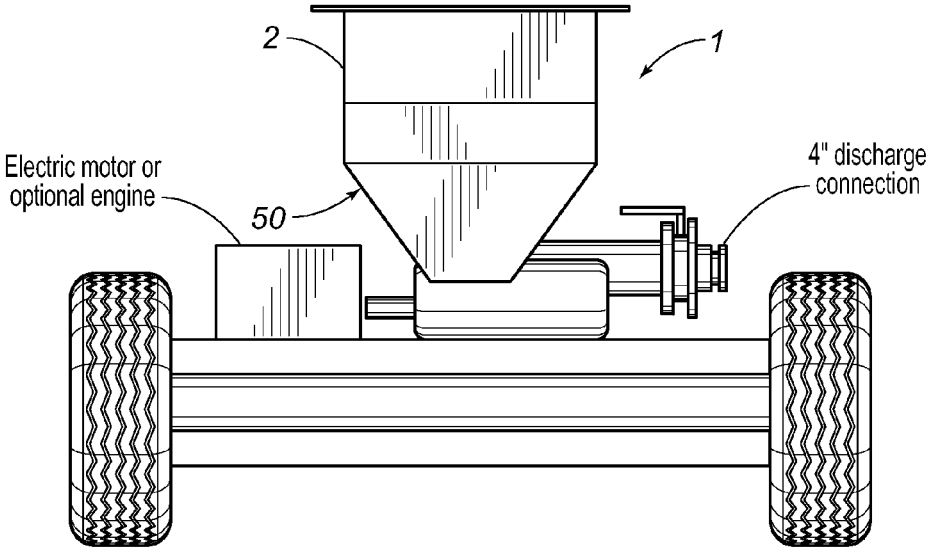
FIG. 8 depicts a right side or end view of the isolated embodiment depicted in FIG. 7, disposed upon a truck trailer.

As can be readily seen specifically from FIGS. 1-3, the external framework of frac sand transport apparatus 1 adapted to afford prerequisite strength and support for accommodating the contemplated sand and/or proppant material loads, comprises brace and truss support assembly 10. More particularly, this brace and truss support assembly comprises each of pair of longitudinal basal cross-braces 7 fixedly interconnected at each end thereof with one of pair of end supports 6 and intermediately thereof with plurality of saddle supports 5. While the base of apparatus 1 structurally devolves to a framework anchored by the fixed interconnection of pair of basal cross-braces 7 and pair of end supports 6 reinforced medially by plurality of saddle supports 5, the upper portion thereof is secured by roof 8. It will also be seen that the structure of frac sand transport apparatus 1 is further secured by medial cross-brace 17 which is affixed to the plurality of saddle supports 5. It should be clearly understood, however, that any of a plethora of similarly situated support assemblies may be invoked and be consistent with the teachings of the present invention, so long as sufficient strength and support is provided for reinforcing the strength and support of conventional ISO containers contemplated hereunder.

Figure 11:
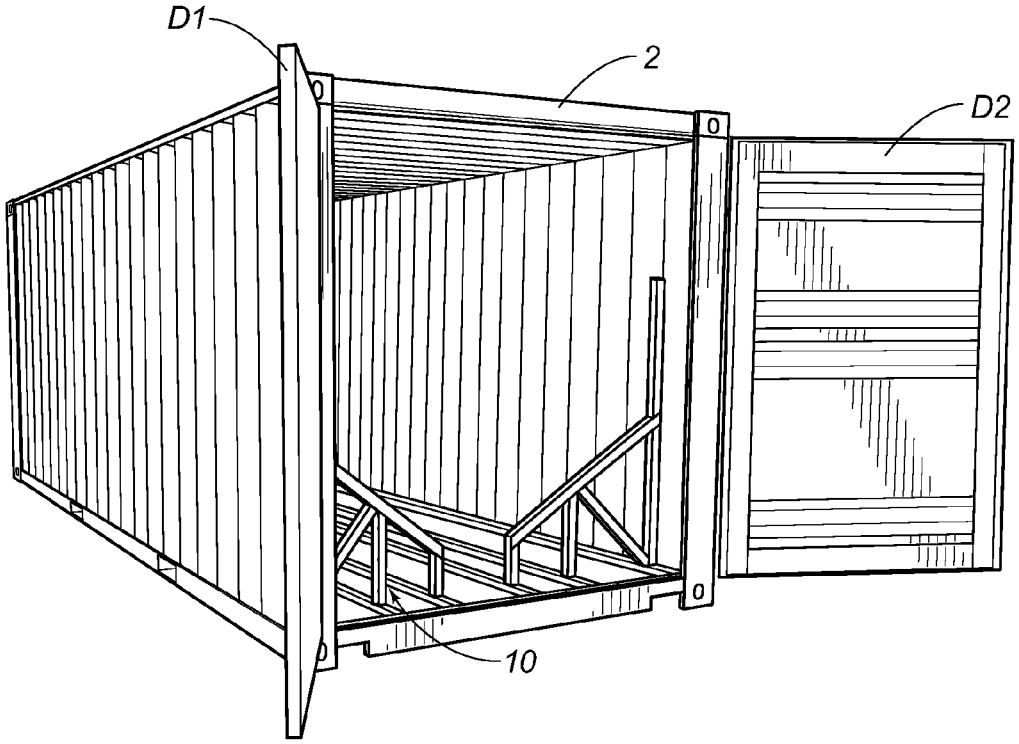
FIG. 11 depicts an end perspective view of a standard ISO container incorporated into embodiments of the present invention, with its end-opening doors disposed in an open position.
Figure 12:
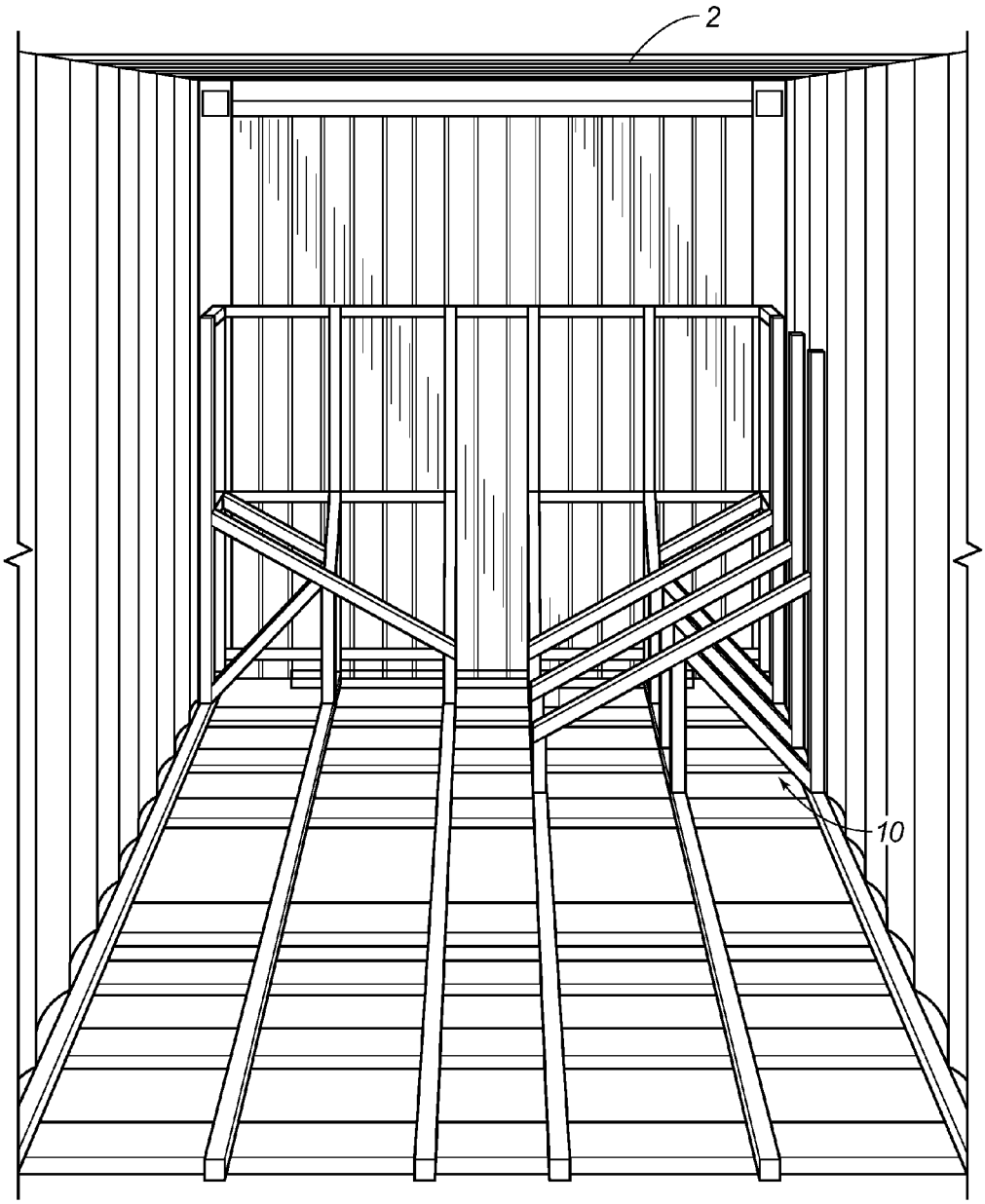
FIG. 12 depicts a frontal perspective view of a portion of internal bracing framework incorporated into the ISO container depicted in FIG. 11.
Figure 13:
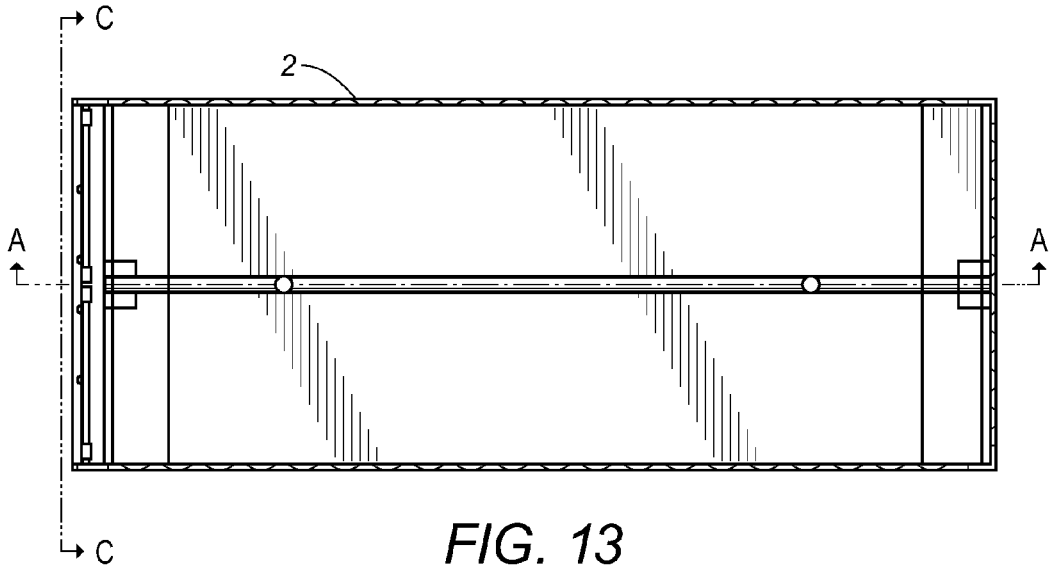
FIG. 13 depicts a plan view of the standard ISO container depicted in FIGS. 11 and 12.
Figure 14:
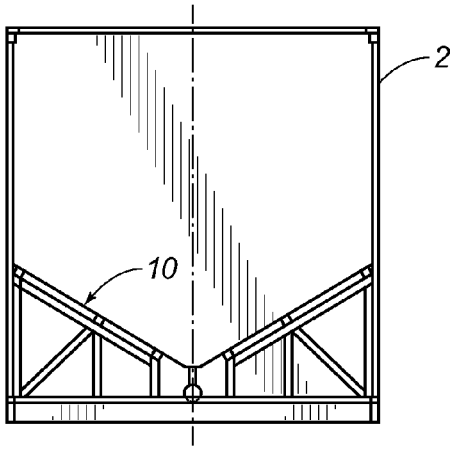
FIG. 14 depicts a cross-sectional view of the standard ISO container depicted in FIGS. 11 and 12, and along line C-C in FIG. 13.
Figure 15:
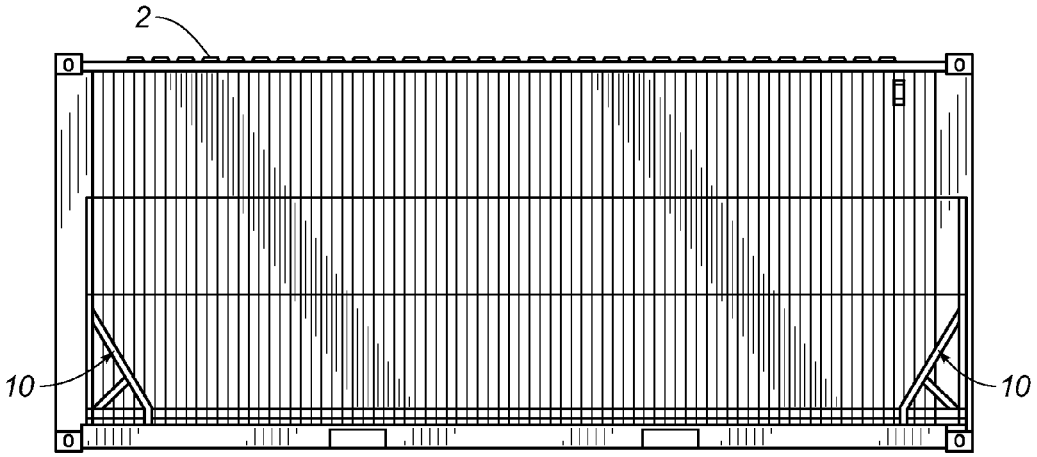
FIG. 15 depicts a sectional view of the standard ISO container depicted in FIGS. 11 and 12, and along center line A-A in FIG. 13.
Figure 16:
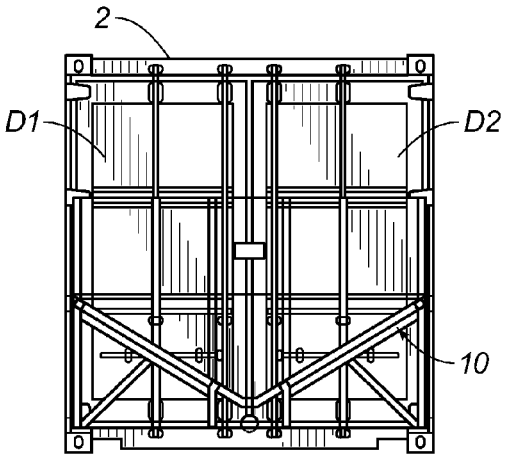
FIG. 16 depicts a door elevation end view of the standard ISO container depicted in FIGS. 11 and 12.
Figure 17:
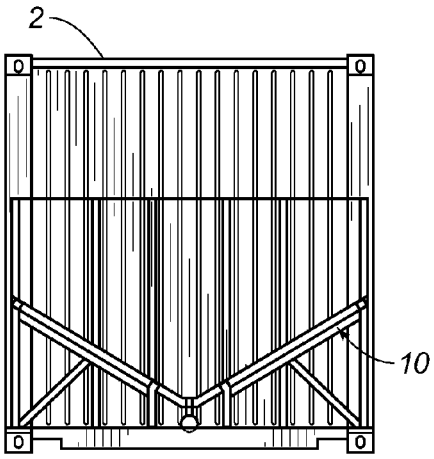
FIG. 17 depicts a rear elevation end view of the standard ISO container depicted in FIGS. 11 and 12.

Now focusing collectively upon FIGS. 7-8 and 11-17, there is depicted a portion of the contemplated in situ brace and truss framework 10 that affords reinforcing strength and support to the internal walls and the like of a standard ISO container 2, and simultaneously encloses the hopper and associated valve assembly embodiments 50 of the present invention. As described herein, such valve apparatus may be mechanical or preferably pneumatic to effectuate industry standard outflow of sand and proppant material contained within the hopper assembly 50 and ISO container 2 as illustrated in the isolated views depicted in FIGS. 7-8. Thus, FIG. 11 depicts an end perspective view of a standard ISO container 1 incorporated into embodiments of the present invention, with its end-opening doors D1 and D2 disposed in an open position. Also depicted therein, is a portion of brace and truss framework 10. FIG. 12 depicts a frontal perspective view of another portion of internal bracing framework 10 incorporated into the ISO container depicted in FIG. 11. FIG. 13 depicts a plan view of the standard ISO container depicted in FIGS. 11 and 12. FIG. 14 depicts a cross-sectional view of the standard ISO container depicted in FIGS. 11 and 12, and along line C-C in FIG. 13. FIG. 15 depicts a sectional view of the standard ISO container depicted in FIGS. 11 and 12, and along center line A-A in FIG. 13. FIG. 16 depicts a door elevation end view of the standard ISO container depicted in FIGS. 11 and 12. FIG. 17 depicts a rear elevation end view of the standard ISO container depicted in FIGS. 11 and 12. Embodiments of the present invention should preferably be structured to endure stress manifest throughout by a maximum of 50,000 pounds of sand material as the specially-adapted containers 1 travel over rough terrain and the like, en route to well sites.

Referring again to FIGS. 1-8, there is seen a pair of tubular input ports 3 disposed atop roof 8, with each input port being secured and sealed with a cap or lid 3A as shown. It will be understood that these input ports are typically 20" manways having water-tight hinged lids that are conveniently manually removed via integrated wing-nuts. Also seen is transverse discharge port 4 with a mechanical valve or the like typically having a 4 inch outlet and a 24"×24" sliding gate valve.

It will be appreciated by practitioners conversant with handling ISO containers 2 and the like that the caps 3A situated atop the 20-inch manways should preferably be situated flush atop such intermodal containers. Accordingly, the lids 3A would preferably be situated just beneath the container roof 8 and, once manually opened, frac sand would be delivered into the hopper portion of apparatus 1. To assure that contained frac sand remains devoid of water incursion, it is contemplated that the apparatus lid could be enclosed within a hingedly-opened cut-out.

It will also be appreciated that a 24"×24" gate valve or the like is particularly advantageous under circumstances in which frac sand is being unloaded into a mobile hopper unit or the like. But, it should be understood that, if such mobile hopper units are apt to be unloaded under the influence of a blower or the like through 4 inch piping, then use of such a gate valve would probably be unnecessary. Of course, those skilled in the art will readily appreciate that, if and when a gate valve were used in conjunction with an embodiment of the present invention, then frac sand would be unloaded or dumped into a dolly hopper or the like. Under such circumstances, the top of the dolly hopper should preferably be constructed from two thin-gauge sheet metal telescoping tubes in order to facilitate sliding thereunder and then being raised to meet the flange disposed on the bottom of the large hopper unit 50.

Figure 18:
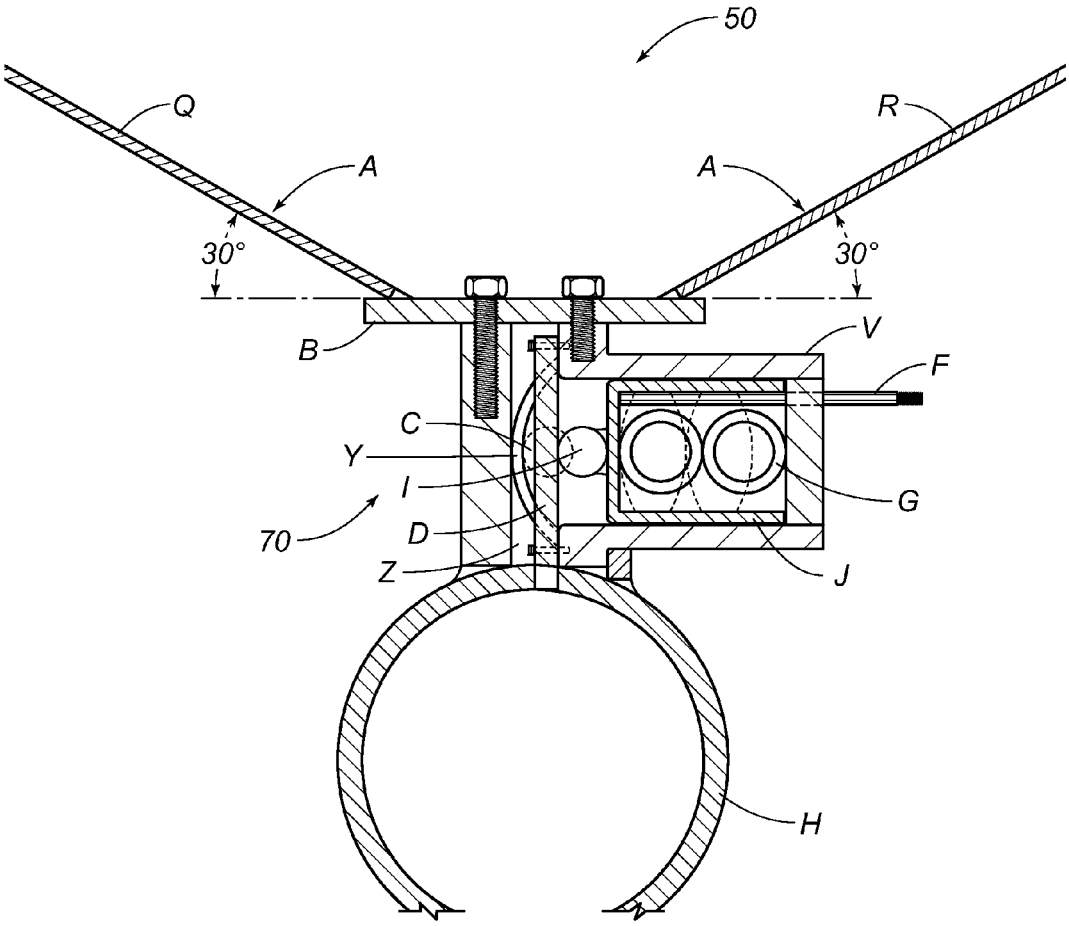
FIG. 18 depicts a simplified frontal view of a single-valve hopper assembly embodiment of the present invention.
Figure 19:
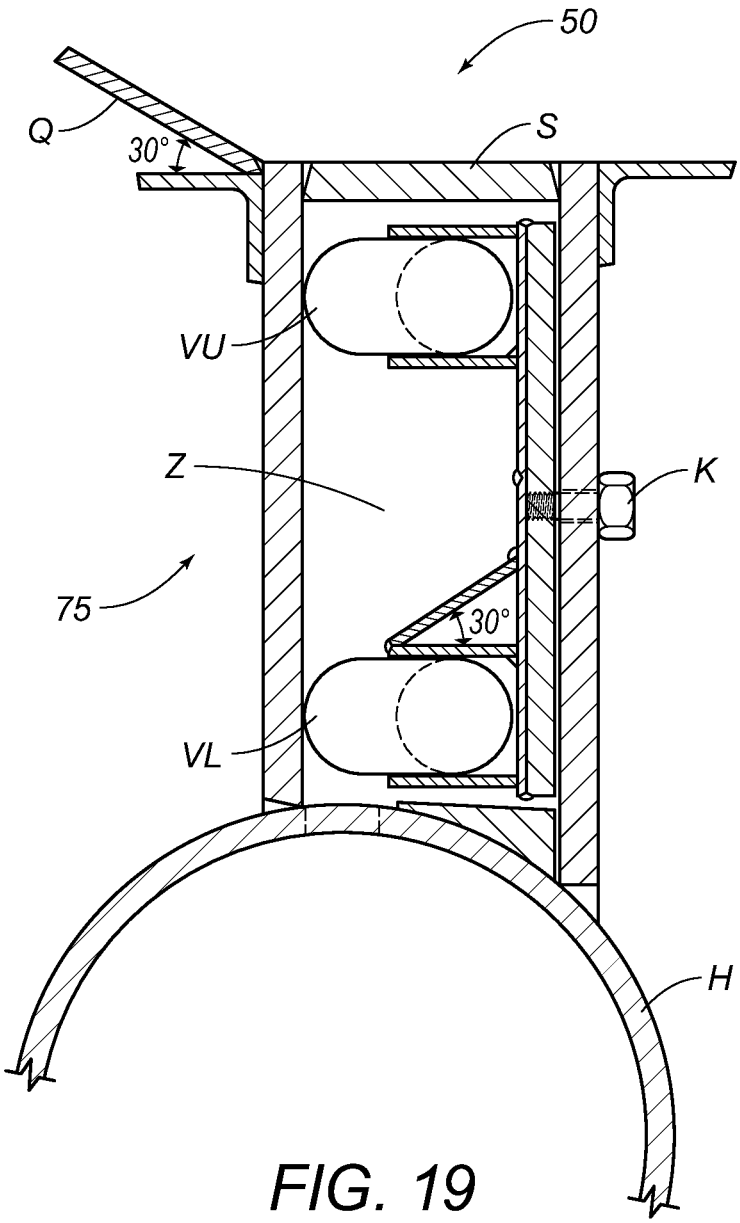
FIG. 19 depicts a simplified frontal view of a dual-valve hopper assembly embodiment of the present invention.

Referring now to FIGS. 18 and 19 there are depicted simplified frontal views of a single pneumatic-valve hopper assembly embodiment 70 of the present invention and a simplified frontal view of a dual pneumatic-valve hopper assembly embodiment 75 thereof, respectively. First focusing on the single-valve embodiment 70 depicted in FIG. 18, there is shown a simplified schematic front view of conversion of a standard 20-foot ISO container 2 to a hopper 50 where all sand is funneled to a central collection trough therebelow. The hopper sides A—long and short—are angulated 30 degrees to be commensurate with white sand angle of repose, and may be formed by welding 10 gauge KSI plate Q to 2"×2"×⅛" steel trusses on 12 inch centers. The interior edge or point of each hopper panel R is welded to the lateral edge of the central aperture of the continuous ¼ inch mounting plate B. This aperture is contemplated to preferably constitute either a ¼ inch or ⅜ inch opening into the vertical channel leading to a 3 inch or 4 inch conveyor pipe H. Within valve body V, piston J and compression rod I are controlled by one or both pneumatic bladder tubes G that are sized with 19 foot length to fit within the 20-foot long ISO container 2. It will be understood by those skilled in the art that the instant embodiment is preferably configured with two pneumatic tubes G for redundantly sealing sand chamber Z, wherein, if one tube fails, the second tube would still remain inflated and the chamber would consequently remain sealed. Piston J advances its associated compression rod from position C to position I thereby displacing the ¼ inch thick high-durometer silicone rubber gasket Y and pushing it into chamber sidewall D, and, in turn, sealing the vertical channel throughout the chamber's approximate 19 foot length. Also depicted is indicator-emergency pull F. Thus, it will be evident that FIG. 18 depicts pair of pneumatic tubes G in an inflated condition and displacing the compression rod and causing gasket Y to become straightened thereby sealing chamber Z. It will also be evident that, when pair of pneumatic tubes G is in a deflated condition, gasket Y ceases to be displaced and frac sand enters chamber Z through the aperture in pipe H and exits ISO container 2 as contemplated hereunder. It should be evident that opening and closing chamber Z is functionally related to inflation and deflation of bladder tubes G.

Figure 21:
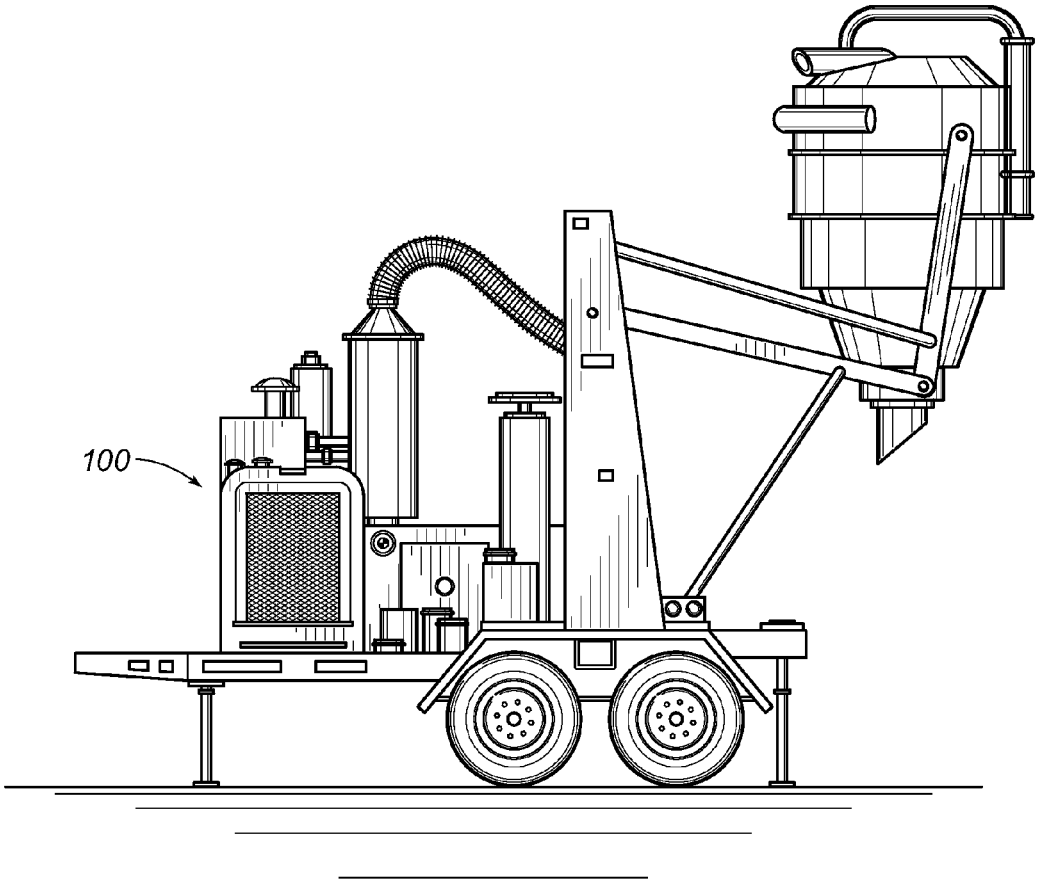
FIG. 21 depicts a frontal perspective view of a portable commercial vacuum suction apparatus for providing compressed air.

FIG. 21 depicts a frontal perspective view of a portable commercial vacuum/suction apparatus 100 for providing the compressed air for effectuating the valve cycling and continuous sand flow as contemplated hereunder. Hence, this suction apparatus affords prerequisite suction for suctioning the frac sand and the like from the conveyor or longitudinal discharge pipe, thereby dumping it into in situ storage located at the rig. Alternatively, the valves may be cycled and the sand driven through the discharge pipe by a commercial compressor.

Now referring to the preferred embodiment of the dual-valve system 75 depicted in FIG. 19, it has been found that configuring a valve system with a pair of complementary pneumatic bladder tubes VU and VL affords optimal discharge of sand and/or proppant material commensurate with the flow rate data tabulated in FIG. 20. Practitioners in the art will appreciate that the implicated chamber portion Z of the valve assembly 50 has a capacity for about 0.3 cubic yards of sand, which corresponds to transfer of about 30 pounds of sand every 3 seconds. In a manner known in the art, cycling frequency is controlled by a circuit board. Pneumatic tube pair depicted herein comprises upper tube VU and lower tube VL which cycle as follows: In Phase 1, as an external compressor 100 (FIG. 21) is activated, the upper tube VU opens/deflates and causes lower tube VL to expand/inflate and simultaneously seal the bottom of the chamber, thereby causing sand to flow through the aperture in plate S into chamber Z. Accordingly, sand/proppant fills the chamber. In Phase 2, upper tube VU inflates/seals and simultaneously the corresponding lower tube chamber VL deflates/opens causing sand to flow through the chamber Z into pipe H. It will be appreciated that as balloon tube VL expands and balloon tube VU contracts, the chamber Z is caused to gravity-fill throughout each of the respective silicone rubber tube's approximate 19-foot length in about 3 seconds subject to the force engendered by about 100 psi pressure. Then, in the next cycle, the opposite valve-bladder tube scenario occurs: the bottom tube VL contracts/deflates and the top tube VU enabling chamber Z to empty sand/proppant in about 3 seconds.

This cycle, with flip-flop relationship of the valve pair V, continues throughout the sand and proppant material offloading process. It will, of course, be clearly understood that the sand material empties into longitudinal discharge pipe under constant pressure to sustain continuous flow from the compressor. This cycling continues preferably every 3 seconds under circuit board control. The dotted line on each of upper valve VU and lower valve VL depicts the relative expanded and compressed state of the valve which alternates compression and expansion with each cycle. It will be appreciated that there is a plate situated from the hopper assembly to the top of the valve body, at an angle of about 31° to promote sand flow.

The space atop the valve assembly is open except for a tension bar member of the brace and truss assembly, for holding the valve body together as its double valve apparatus causes sand to continuously flow downwards into the injection chamber and ultimately downhole. This tension bar should preferably be invoked every 6 inches to afford sufficient stability to the hopper assembly and implicated valve apparatus. It should, of course, be clearly understood that, while the cyclical reversal of the double pneumatic valve configuration of the present invention causes the injection chamber to constantly be full of sand and proppant and to enable efficient downward flow into discharge pipe H, the hopper assembly must be sealed from the high pressure manifest in the discharge pipe. Ergo, a key aspect of embodiments of the present invention is that the adapted ISO container frac sand apparatus is completely sealed throughout its participation in the fracturing process—from end to end. Obviously, there can never exist positive pressure from the discharge pipe back into the container per se. The suction provided by an external compressor achieves the crucial function of alternatively compressing each of the valve pair as herein described in detail. It is also seen that there is a preferably self-threaded knurled knob K emplaced on a side of the valve apparatus for inserting and removing the 19-foot silicone balloon or hose members. There is also displayed a stabilizer bar S and hopper plate Q It will be appreciated that the container must be sealed throughout sand material loading and unloading in order to avoid vigorously blowing sand upwardly in the wrong direction. Obviously, the proper protocol is to unload the sand material under pressure into the discharge pipe and ultimately downhole at the well site. There must be inherent safeguards, as in embodiments of the instant invention, against such unacceptable contrary sand flow.

Thus, since it is well known in the art that gravity flow is inadequate for feeding sand and proppant material to well sites for fracking, the present invention teaches how to reliably achieve prerequisite sand flow rates under the influence of suction supplied externally by a mobile commercially-available compressor. Still referring to the tabulation of sand valve discharge flow rates enumerated in FIG. 20, the necessary parameters to sustain industry standard fracking operations are illustrated. It will be seen that merely pulling down sand and the like via gravity is incapable of reaching industry standards, wherein loads of about 40,000 pounds must be offloaded in about 30 minutes, devolving into flow rate of 1200 pounds of sand per minute.

This table is subdivided into four portions having cycles per minute from as high as 60 to as low as 4. The first portion consists of rows 1-10 corresponding to a single valve apparatus having valve volume of 0.25 cubic feet; in order to attain sand flow discharge in an hour or less, 33 minutes, with a discharge rate of 1500 pounds per minute, a cycle time per minute of 60 is prerequisite (first row of first portion). In the third portion of this tabulation, consisting of rows 21-30 corresponding to a single valve apparatus having valve volume of 0.4 cubic feet; in order to attain sand flow discharge in an hour or less, 41 minutes, with a discharge rate of 1208 pounds per minute, a cycle time per minute of 30 is prerequisite (second row of third portion).

The second portion consists of rows 11-20 corresponding to a double valve apparatus having valve volume of 0.5 cubic feet; in order to attain sand flow discharge in an hour or less, 50 minutes, with a discharge rate of 1000 pounds per minute, a cycle time per minute of 20 is prerequisite (third row of second portion). In the fourth portion of this tabulation, consisting of rows 31-40 corresponding to a double valve apparatus having valve volume of 0.8 cubic feet; in order to attain sand flow discharge in an hour or less, 51 minutes, with a discharge rate of 966 pounds per minute, a cycle time per minute of 12 is prerequisite (fifth row of fourth portion).

But, this double-valve arrangement with total valve volume of 0.8 cubic feet would be optimal at 15 cycle per minute wherein 1208 pounds of sand are transferred per minute and unload time of about 41 minutes to unload about 50,000 pounds.

Accordingly, assuming transfer of 50 pounds of sand into the injection chamber with each 4 second cycle, then 750 pounds enter per minute. In a one-hour time period, 45,000 pounds of sand are transferred. It will be readily observed by those conversant in the art that this is essentially the practical capacity of standard ISO shipping containers for transport over highway and rail. As herein described, industry standard requires that this load be emptied within one hour. As demonstrated herein, preferred embodiments of the present invention have achieved this objective.

Thus, it can be readily appreciated that embodiments of the present invention comprise internally modified conventional ISO intermodal shipping containers wherein a plurality of brace members and truss members have been interconnected to strengthen the lateral walls thereof. Furthermore, this plurality of brace members and truss members are affixed to each of container interior side walls, front walls, and rear walls to allow attachment of the steel or aluminum plates that form the contemplated hopper-funnel assembly and enclosed valve control apparatus. It is seen that embodiments of this hopper assembly enable sand and/or proppant to be expeditiously funneled to a central collection trough member. In so doing, the hopper assembly respective long side and short side are angulated at a 30-31° relative to the horizontal to promote downward flow of sand material.

Figure 9:
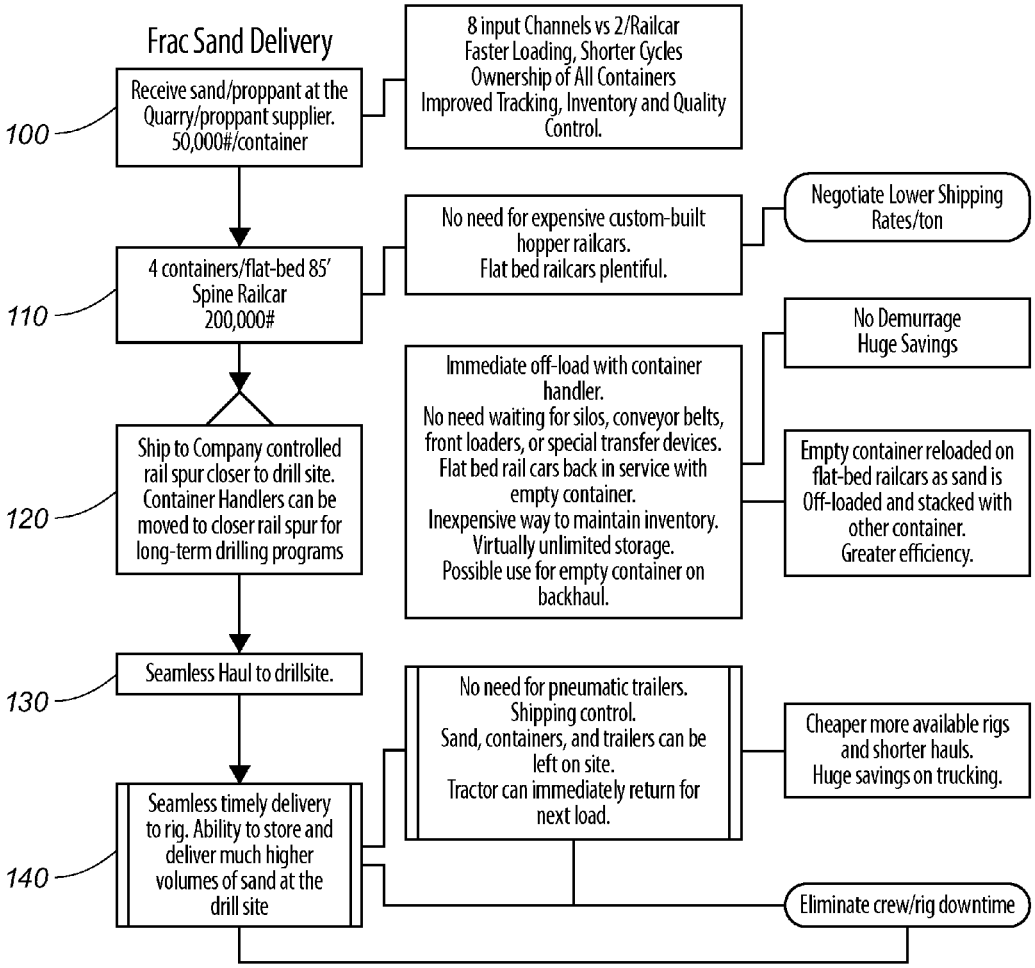
FIG. 9 depicts a system flow chart describing the stepwise logistics of effectuating frac sand delivery according to embodiments of the present invention.

Now referring to FIG. 9, there is depicted a system flow chart of the preferred embodiment of the present invention as applied to a particular frac or delivery scenario. In step 100, frac sand and/or proppant are loaded at a quarry or a supplier thereof, e.g., in a 50,000 pound container. In step 110, three containers, corresponding to 150,000 pounds, are emplaced upon a flat-bed or spine railcar. Then, in step 120, these frac sand containers are transported to a trans-loading facility proximal to a well site, thereby necessitating, in step 130, a relatively short haul of the frac sand and proppant to a rig. As appropriate, as will be hereinafter described, in step 140, frac sand and proppant are stored—environmentally safe and waterproof—in a manner heretofore unknown in the art.

Besides the hereinbefore described steel/aluminum frac sand transport and delivery module, another embodiment of the modular apparatus contemplated by the present invention corresponds to a bladder apparatus using high-density elastomer and like material. Those skilled in the art will recognize that the instant bladder apparatus is constructed with material similar to what is typically used in military fuel storage facilities. For such an embodiment, the central bladder would hold frac sand material and a plurality of side-bladders would be inflated to control both the rate and extent of frac sand and proppant discharge.

It should be understood by those practitioners conversant in the art that, regardless of which frac sand apparatus embodiment is invoked for a particular well site fracking scenario, the present invention teaches adapting a suitably modified ISO intermodal shipping container or like container specifically for achieving efficient frac sand transportation heretofore not contemplated in the art. A particular benefit of herein described embodiments is facilitating maximum payload delivery of the enclosed materials, and, in so doing, assuring economical delivery thereof. For instance, the instant apparatus and concomitant methodology are designed to deliver nearly 50,000 pounds of sand/proppant per trip. It will be readily appreciated that any greater payload exceeds highway weight limitations allowed for safe trucking. Of course, any substantially lesser payload adversely impacts transportation economics.

It is also within the teachings of the present invention to effectuate fracking operations invoking an embodiment having two pairs of double pneumatic valves implemented with four hard durometer silicone rubber tubes disposed throughout the 19-foot length of the suitably-adapted ISO shipping container. Other things being equal, this plurality of double pneumatically-controlled valves has the potential of achieving reliable, environmentally-safe sand material flow rates heretofore unknown in the art.

It should also be appreciated that a major economic advantage of the instant modified intermodal container methodology is virtual elimination of pneumatic truck wait/down time at drilling sites. Embodiments of the present invention comprising the container/hopper/trailer assembly structures taught herein can be immediately separated from a truck or the like for subsequent suitable well site positioning and payload delivery. Moreover, elimination of truck idling/waiting time at the drill-site dramatically reduces carbon dioxide emissions—with clear benefit to the environment and to drill-site workers' health.

As will also be appreciated by those skilled in the art, the trailer-and-container assemblies contemplated hereunder are inherently more mobile and consume considerably less space than more cumbersome pneumatic trucks. Indeed, a flatbed trailer chasis is more easily aligned and positioned for faster material transfer at the well site. FIG. 10 depicts a spreadsheet that tabulates a plethora of advantages of embodiments of the present invention. It should be understood that embodiments of the present invention enable frac sand and associated abrasive materials to be loaded at the processor even when there is no hopper car or pneumatic truck available. Once sealed in such embodiment, the integrity of the enclosed material is inherently sustained. Degradation from abrasion and friction during transfers thereof are virtually eliminated. Likewise, possibility of moisture and rain exposure during transfer have been substantially eliminated.

Furthermore, there is no need for expensive bulk-carrying rail hopper cars to transport the material. A more efficient, reliable and inexpensive methodology according to the teachings of the present invention now exists for maintaining frac fluid inventory—with virtually unlimited storage.

Other frac sand transport apparatus variations and modifications will, of course, become apparent from a consideration of the structures and techniques hereinbefore described and depicted. Nevertheless, it should be clearly understood that the present invention is not intended to be limited by the particular features and structures hereinbefore described and depicted in the accompanying drawings, but that the present invention is to be measured by the scope of the appended claims.

What is claimed is:

1. In a standard 20-foot ISO intermodal shipping container having a plurality of walls including a first pair of parallel longitudinal walls and a second pair of parallel transverse walls, with said second pair of parallel transverse walls perpendicular to said first pair of parallel longitudinal walls, with one wall of said pair of transverse walls having a door disposed thereupon, and also having a floor and a roof perpendicular to said plurality of walls, a frac sand transporting apparatus comprising:

a first plurality of input ports disposed atop said roof with each of said input ports coupled with a first output pipe located in situ at a frac sand processing facility;

a brace and truss framework enclosed within said standard 20-foot ISO intermodal rectangular shipping container and affixed to said plurality of walls, said floor and said roof, for reinforcing the strength of said plurality of walls, said floor and said roof by said brace and truss framework;

a hopper assembly disposed within and affixed to said brace and truss framework forming a sealable enclosure for receiving frac sand and/or proppant material from said first plurality of input ports, with said frac sand and/or proppant material collected and stored in a central chamber member disposed therewithin;

said central chamber member disposed parallel to and longitudinally of said floor throughout the length of said ISO intermodal rectangular shipping container, and having a pair of arms forming a funnel member at a vertex thereof, with each arm of said pair of arms angled at about 31° relative to a horizontal base plate disposed therebetween and affixed at each end thereof to said brace and truss framework, to urge said sand and/or proppant material into said central chamber member, and also having a pneumatic controller fluidly interconnected with a valve apparatus and an external compressed air source;

a second plurality of output discharge ports disposed upon an external transverse surface of said hopper assembly, with each said output port thereof coupled to a second discharge pipe located in situ at a well site for transfer of said sand and/or proppant material downhole from said central chamber member;

said valve apparatus disposed within said hopper assembly parallel to and longitudinally of said floor throughout the length of said ISO intermodal rectangular shipping container, for pneumatically controlling flow of said frac sand and/or proppant material from said central chamber member to said second plurality of output discharge ports and, in turn, into said second discharge pipe; and said bladder-tube member cyclically inflated and deflated by a programmed circuit board contained within said pneumatic controller in order to control corresponding cyclical continuous input and discharge of said frac sand and/or proppant material.

2. Said frac sand transporting apparatus recited in claim 1, wherein said brace and truss framework is configured for being slidably inserted into said ISO intermodal rectangular shipping container.

3. Said frac sand transporting apparatus recited in claim 1, wherein said reinforcement of the strength of said plurality of walls, said floor and said roof of said ISO intermodal rectangular shipping container with said brace and truss framework is sufficient for holding up to about 50,000 pounds of frac sand and/or proppant material therein.

4. Said frac sand transporting apparatus recited in claim 3, wherein said valve apparatus comprises a piston and interconnected rod alternately disposed in a first compression position or a second expansion position of said piston as a function of whether said bladder-tube member is inflated or deflated, respectively, thereby causing a gasket member disposed adjacent a sidewall of said chamber to seal said chamber wall while said chamber is being filled with said frac sand and/or proppant material, when said bladder-tube member is inflated.

5. Said frac sand transporting apparatus recited in claim 4, wherein said bladder-tube member redundantly comprises a first bladder-tube and an adjacent parallel second bladder-tube to assure that said sealing of said chamber is achieved by said gasket member.

6. Said frac sand transporting apparatus recited in claim 3, wherein said valve apparatus comprises a first bladder-tube and a cyclically related parallel second bladder-tube spaced apart from and disposed below said first bladder-tube, wherein said first bladder-tube is deflated when said second bladder-tube is inflated, thereby causing said central chamber to fill with said frac sand and/or proppant material, and said first bladder-tube is inflated when said second bladder-tube is deflated, thereby causing said central chamber to discharge said frac sand and/or proppant material.

7. Said frac sand transporting apparatus recited in claim 3, wherein each of said input ports of said first plurality of input ports comprises a pivotable water-tight lid that seals each said input port after said frac sand and/or proppant material has been stored in said central chamber member at said frac sand processing facility.

* * * * *